US008713826B1

(12) United States Patent
Johnson et al.

(10) Patent No.: US 8,713,826 B1
(45) Date of Patent: May 6, 2014

(54) DISPLAY END UNIT STRUCTURE

(71) Applicants: Terry J. Johnson, Chicago, IL (US); Travis Ogden Johnson, Chicago, IL (US)

(72) Inventors: Terry J. Johnson, Chicago, IL (US); Travis Ogden Johnson, Chicago, IL (US)

(73) Assignee: Gamon Plus, Inc., Elk Grove Village, IL (US)

( * ) Notice: Subject to any disclaimer, the term of this patent is extended or adjusted under 35 U.S.C. 154(b) by 0 days.

(21) Appl. No.: 13/650,058

(22) Filed: Oct. 11, 2012

(51) Int. Cl.

| | |
|---|---|
| ***G09F 23/00*** | (2006.01) |
| *G09F 7/10* | (2006.01) |
| *A47B 73/00* | (2006.01) |
| *A47B 96/02* | (2006.01) |

(52) U.S. Cl.
CPC . *G09F 23/00* (2013.01); *G09F 7/10* (2013.01); *A47B 73/006* (2013.01); *A47B 96/02* (2013.01)
USPC ..... 40/606.03; 40/606.12; 40/611.06; 40/611.08; 211/153

(58) Field of Classification Search
CPC ..... G09F 23/00; G09F 7/10; A47B 73/006; A47B 96/02
USPC ..... 40/606.03, 606.12, 611.06, 611.08; 211/153
See application file for complete search history.

(56) References Cited

U.S. PATENT DOCUMENTS

| | | | | |
|---|---|---|---|---|
| 1,567,774 | A * | 12/1925 | Vance | 108/96 |
| 2005/0167376 | A1* | 8/2005 | Carter | 211/59.1 |
| 2006/0070285 | A1* | 4/2006 | Grant | 40/651 |
| 2010/0078401 | A1* | 4/2010 | Vulpitta | 211/153 |
| 2010/0117496 | A1* | 5/2010 | Clarke et al. | 312/140.1 |
| 2010/0326939 | A1* | 12/2010 | Clark et al. | 211/153 |
| 2011/0042331 | A1* | 2/2011 | Johnson et al. | 211/49.1 |
| 2013/0081311 | A1* | 4/2013 | Luo et al. | 40/584 |

* cited by examiner

*Primary Examiner* — Gary Hoge
(74) *Attorney, Agent, or Firm* — Tiajoloff and Kelly LLP

(57) ABSTRACT

A rack system for displaying products comprises a rack unit supporting some of the products so as to be accessed at a forward facing product dispensing face. The rack unit has a side portion facing generally perpendicular to the dispensing face. A corner member is supported on the side portion and comprises a first wall portion extending generally forwardly to a vertical edge adjacent the product dispensing face, and a second wall portion extending generally laterally outward from the side portion to a second vertical edge. The first and second edges each have a retaining portion extending vertically. A flexible signage member is supported on the corner member in a flexed condition between the retaining portions with a signage surface that is concave outwardly between the retaining portions. The signage member is supported and retained on the corner member by a biasing of the signage member to extend wider than a distance between the retaining portions.

15 Claims, 11 Drawing Sheets

DISPLAY END UNIT STRUCTURE

FIELD OF THE INVENTION

The field of the disclosure is the display of products and advertising in a retail setting, especially in which product racks with substantial depth are used at the ends of aisles in a store setting.

BACKGROUND OF THE INVENTION

Retail operations rely on a variety of means to efficiently display products to consumers. One aspect of display of products is maximizing the surface area used for either product display or advertisement in a given volume of store space. For example, stores often place shelves in aisle formations configured to increase the available display area. Also, the shelves are often at least the height of a person and extend up to an upward pointy corresponding to at least the average person's reach, also maximizing the display area for products in a given space for viewing by customers.

Another related concern in retail operations is the removal of products by customers and the unused space left behind. A common solution is to stack additional copies of a product behind the original, often with a system that provides for products to move forward automatically as products are taken from the front of the display. To hold a more substantial number of products, the displays must be constructed with greater depth.

The depth of the display racks creates an unused additional lateral area on the sides of the racks that retailers can utilize. Referring to FIG. 12, usually, display racks 101 each having two opposing lateral sides 102 are arranged side by side and back to back so as to define aisles 103 toward which product display and access faces 104 are disposed. In such a configuration of aisle units 101, the lateral sides 102 of only the last aisle units 101 are exposed.

One solution to the exposed ends of the racks 101 at the end of the aisles 103 is to use the entire lateral area as advertising space. Although this may provide effective advertisement delivery, it is often less important for a retailer to display advertising in a store than to display additional products. Another solution is to stock additional products across the lateral area in an end unit 105 as seen in FIG. 10, with an outward facing product display and access surface 111. Unfortunately, the depth of the end unit rack 105 leaves it with its own exposed lateral surfaces 109, and together with the exposed portions of lateral sides 102 of the last two aisle units 101, defines a wasted corner space 107 on both sides of the end unit 105. This wasted lateral corner area may be reduced by the use of smaller racks having less depth, but a problem remains of how to effectively use the remaining corner area.

In addition, the exposed sides of the aisle and end units 101 and 105 are to a degree exposed to a risk of impact by shopping carts, that might damage por dislodge the units or products on them.

SUMMARY OF THE INVENTION

It is accordingly an object of the invention to provide a structure that makes beneficial use of the lateral side of a display rack, especially in the corner space between an aisle rack and an end unit at the end of an aisle.

According to an aspect of the invention, a rack system for displaying products comprises a rack unit supporting some of the products so as to be accessed at a forward facing product dispensing face. The rack unit has a side portion facing generally perpendicular to the dispensing face. A corner member is supported on the side portion and comprises a first wall portion extending generally forwardly to a vertical edge adjacent the product dispensing face, and a second wall portion extending generally laterally outward from the side portion to a second vertical edge. The first and second edges each have a retaining portion extending vertically. A flexible signage member is supported on the corner member in a flexed condition between the retaining portions with a signage surface that is concave outwardly between the retaining portions. The signage member is supported and retained on the corner member by a biasing of the signage member to extend wider than a distance between the retaining portions.

According to another aspect of the present invention, usage is made of a display space created in a dispensing system having substantial depth behind its dispensing face, and consequently a substantial lateral area. In cases where the product display rack is an end-unit and does not extend the full width of the depth of the central dispensing racks of the aisle, an unused L-shaped corner space is created. By extending an outwardly-concave signage imagery display across part of the space, a more effective visual display is created. The concave shape provides for better viewing of the imagery from more angles, making the concave display particularly well-suited for advertisements. The signage also provides protection for the display rack from impacts by shoppers or shopping carts.

Other objects and advantages of the invention will become apparent from the specification herein.

DETAILED DESCRIPTION

Figure 1:
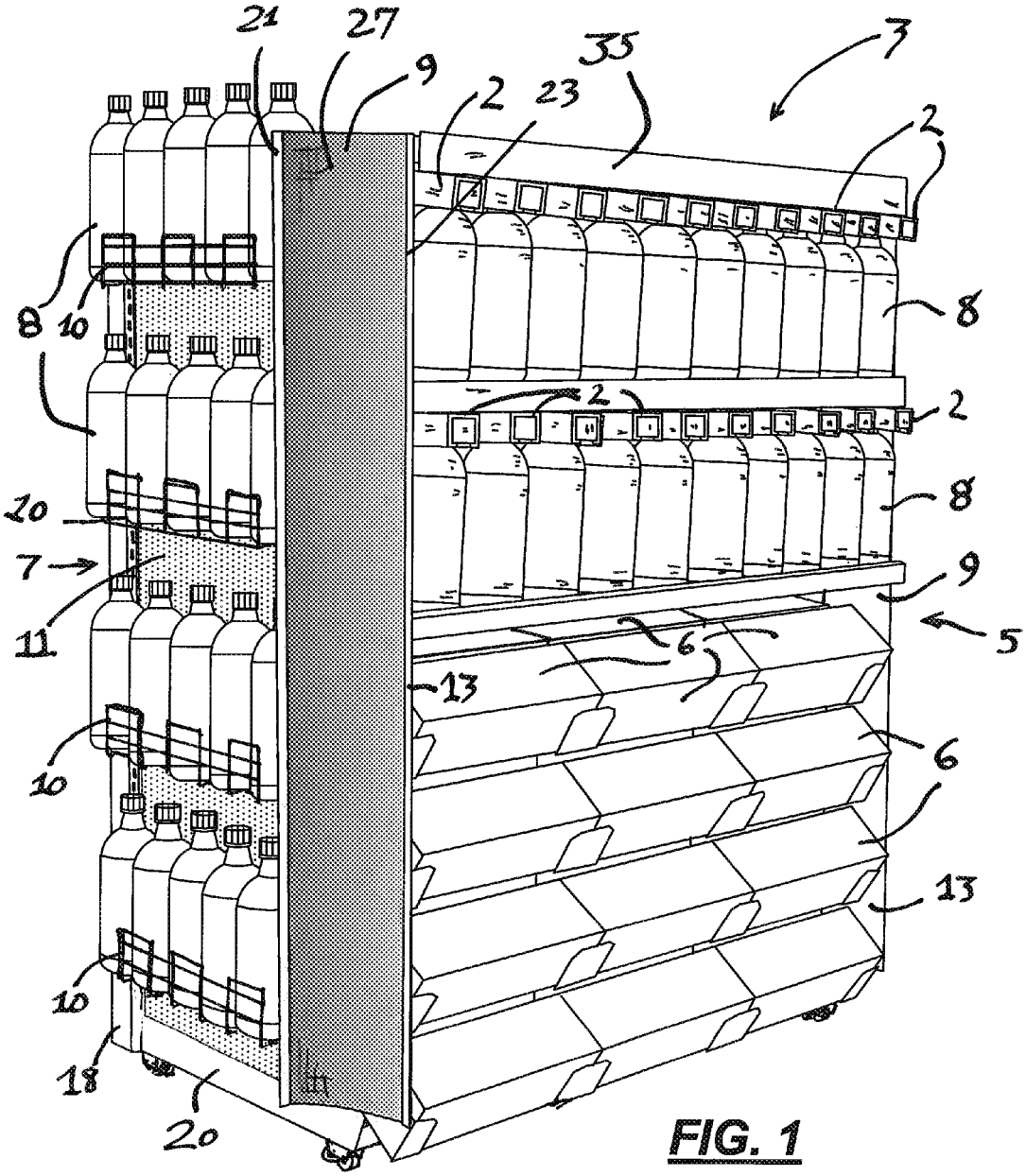
FIG. 1 is a perspective view of a display rack according to the invention.

FIG. 1 is a perspective view from the left side of a product display rack 3 according to the invention, i.e., a dispenser for products on a store shelf. The display rack 3 is symmetrical about the vertical center plane CL (see FIGS. 3 and 13), so a perspective view of the other side of the rack, i.e., the right side, is a mirror image of the view seen in FIG. 1.

The display rack 3 uses various structures to display and dispense products at a front face 5 thereof. The products in the embodiment shown are, e.g., cartons 6 of cans and bottles 8. The dispensing mechanisms for these products may be any of a variety of designs, and particularly preferred are carton dispensing structures such as shown in international application serial number PCT/US2011/027261 filed on Mar. 4, 2011 and published as WO/2011/109749 on Sep. 9, 2011, and in international application serial number PCT/US2012/050009 filed on Aug. 8, 2012, both of which are herein incorporated by reference. The structures displaying the bottles 8 for access and loading include diagonal channel beams 2 that are all essentially identical, and support the bottles 8 suspended therefrom. The structures deploying the cartons 6 allow for customers to remove the cartons below the hanging bottle displays.

Figure 2:
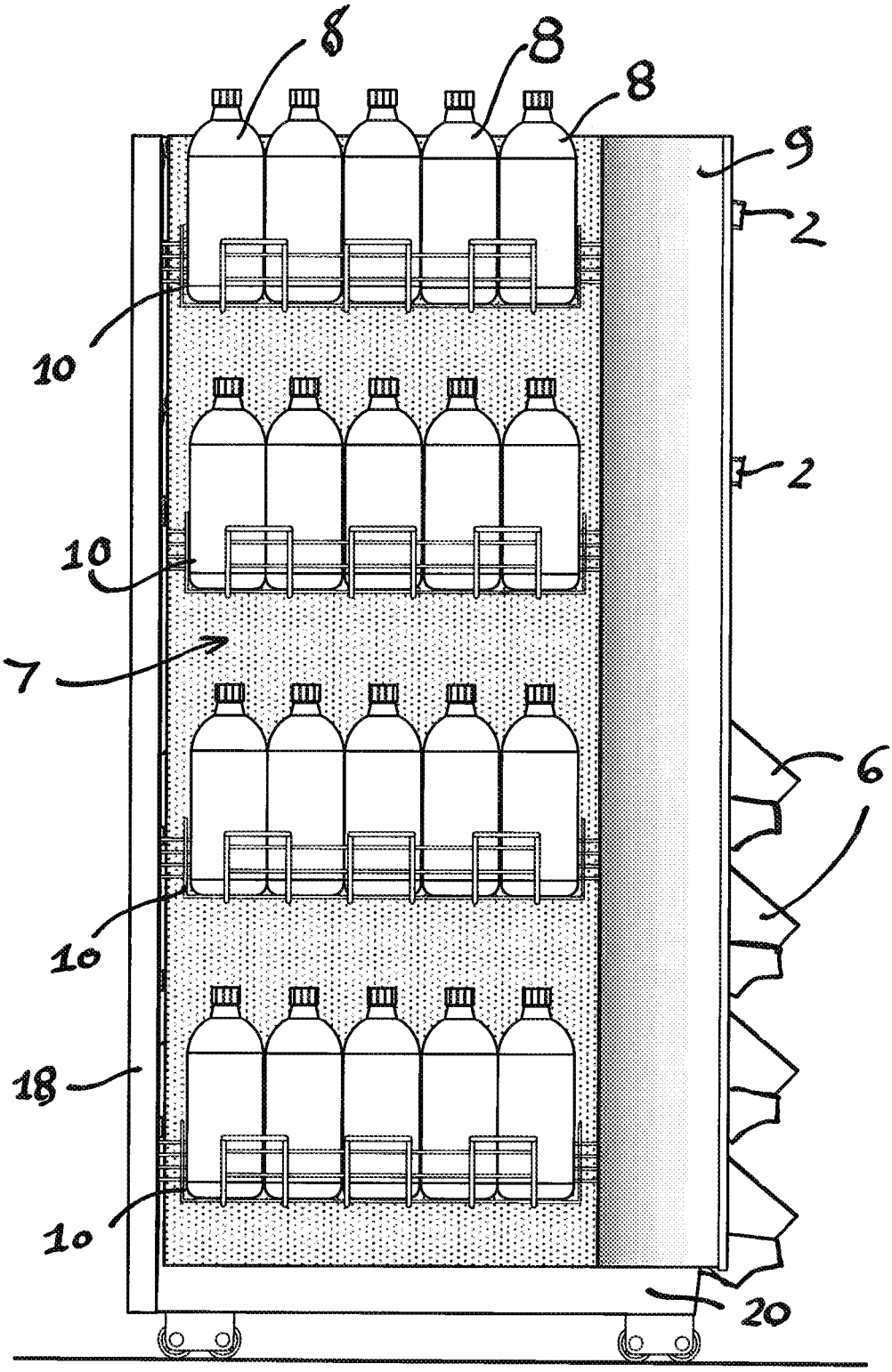
FIG. 2 is a left side view of the display device of FIG. 1, which is a mirror image of the right hand side view.
Figure 3:
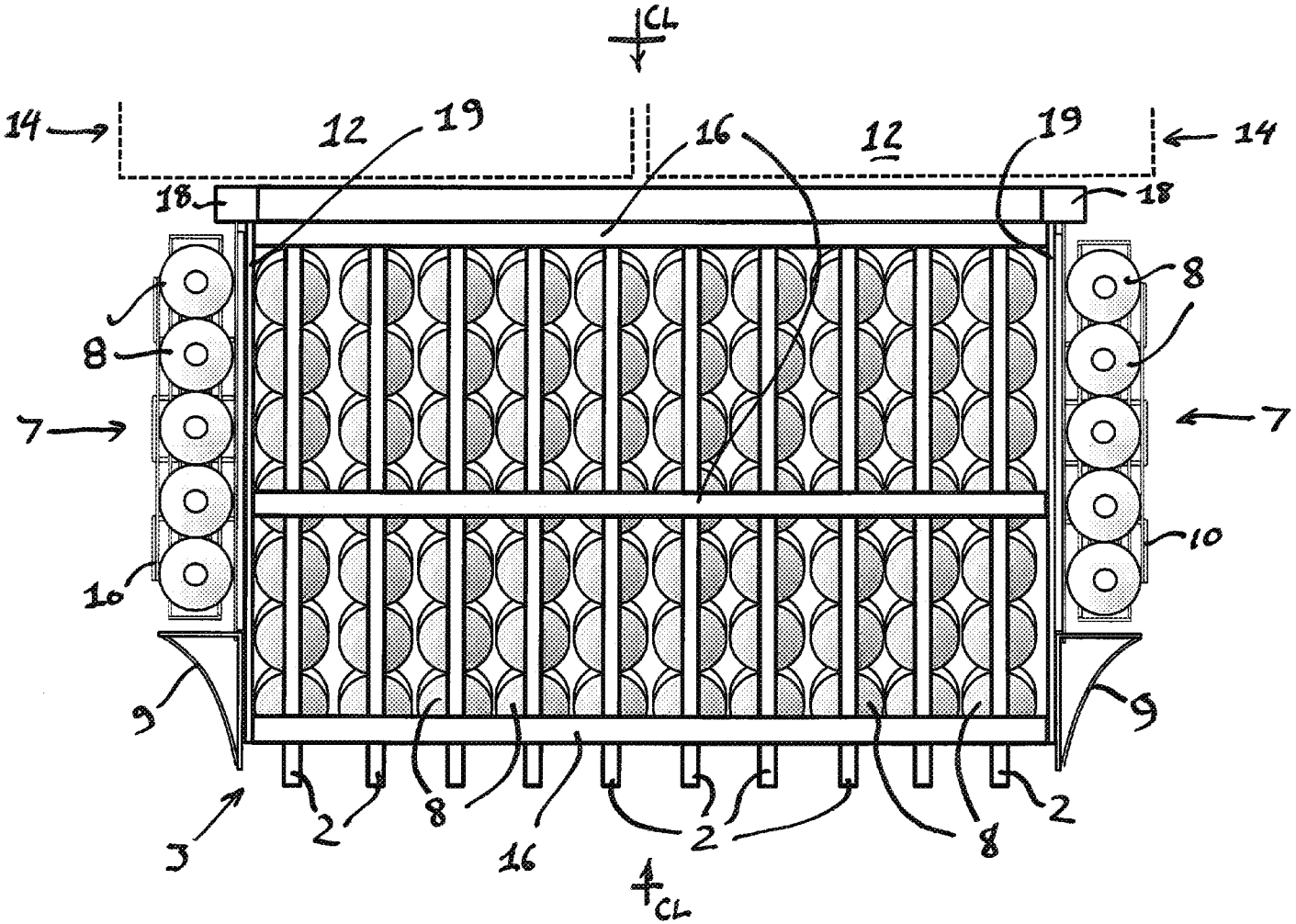
FIG. 3 is a top view of the display device of FIG. 1.
Figure 13:
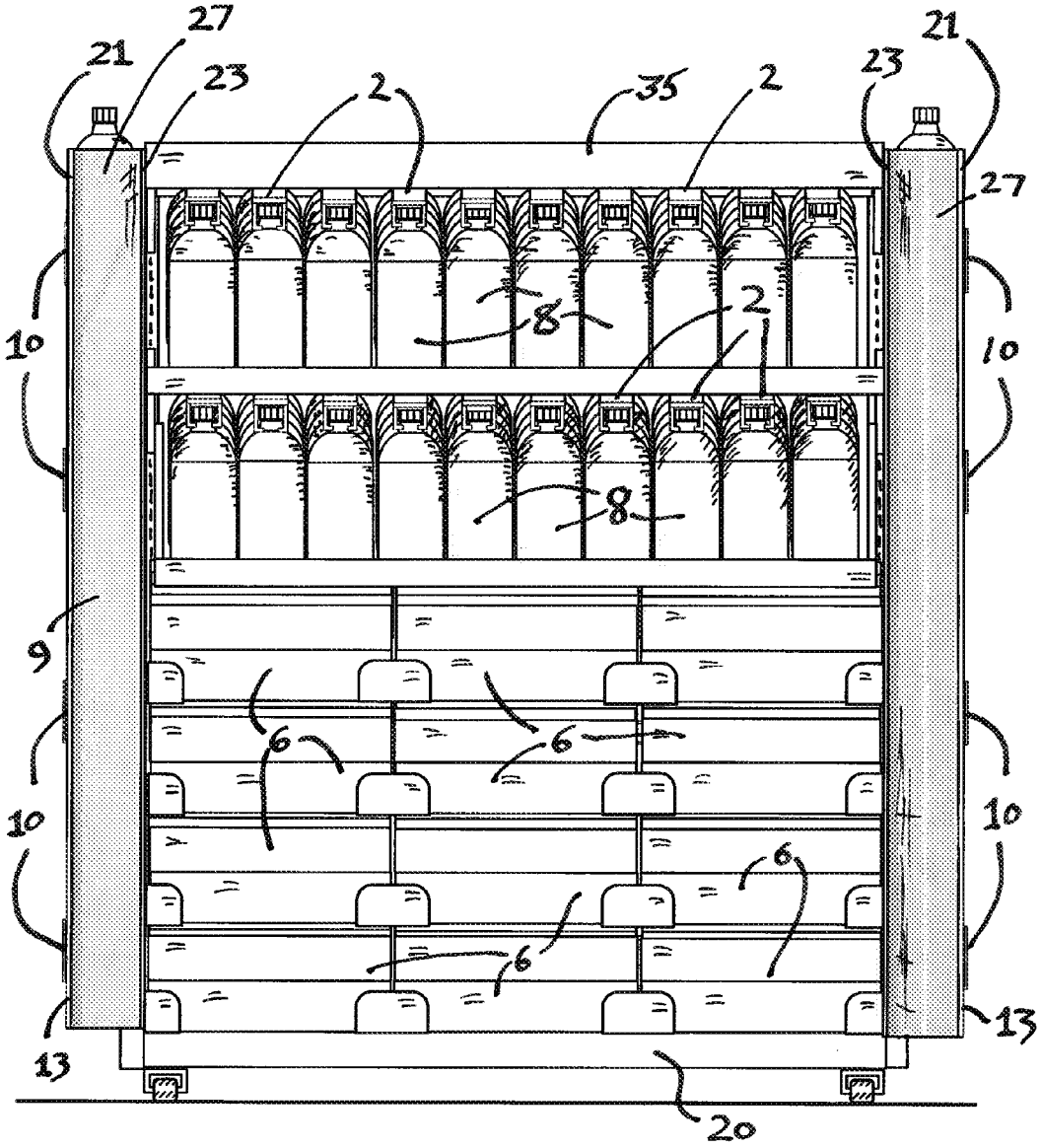
FIG. 13 is a front view of the display rack of FIG. 1.

Referring to FIGS. 2, 3 and 13, the display rack 3 is preferably an end unit, and has one or both of its lateral sides exposed as faces generally indicated at 7. The lateral sides support a plurality of wire basket shelves 10 each holding products such as bottles 8. In addition, between the front face 5 and the lateral faces 7, rack 3 has supported thereon corner structures 9, which include a concave flexible signage member held by a generally L-shaped corner member 13, as will be described below.

Referring to FIG. 3, end unit 3 extends forwardly from the lateral sides of two back-to-back aisle units 12, which may be racks similar to the end unit 3, ordinary shelves, or any other designs of display rack, of a similar height to rack 3. The aisle units 12 both have aisle directed faces 14. The rack 3 is so configured that the corner strictures 9 and the side display structures, e.g., wire basket shelves 10 and the retained products 8, do not extend laterally beyond the face 14 of the aisle display units.

Figure 4:
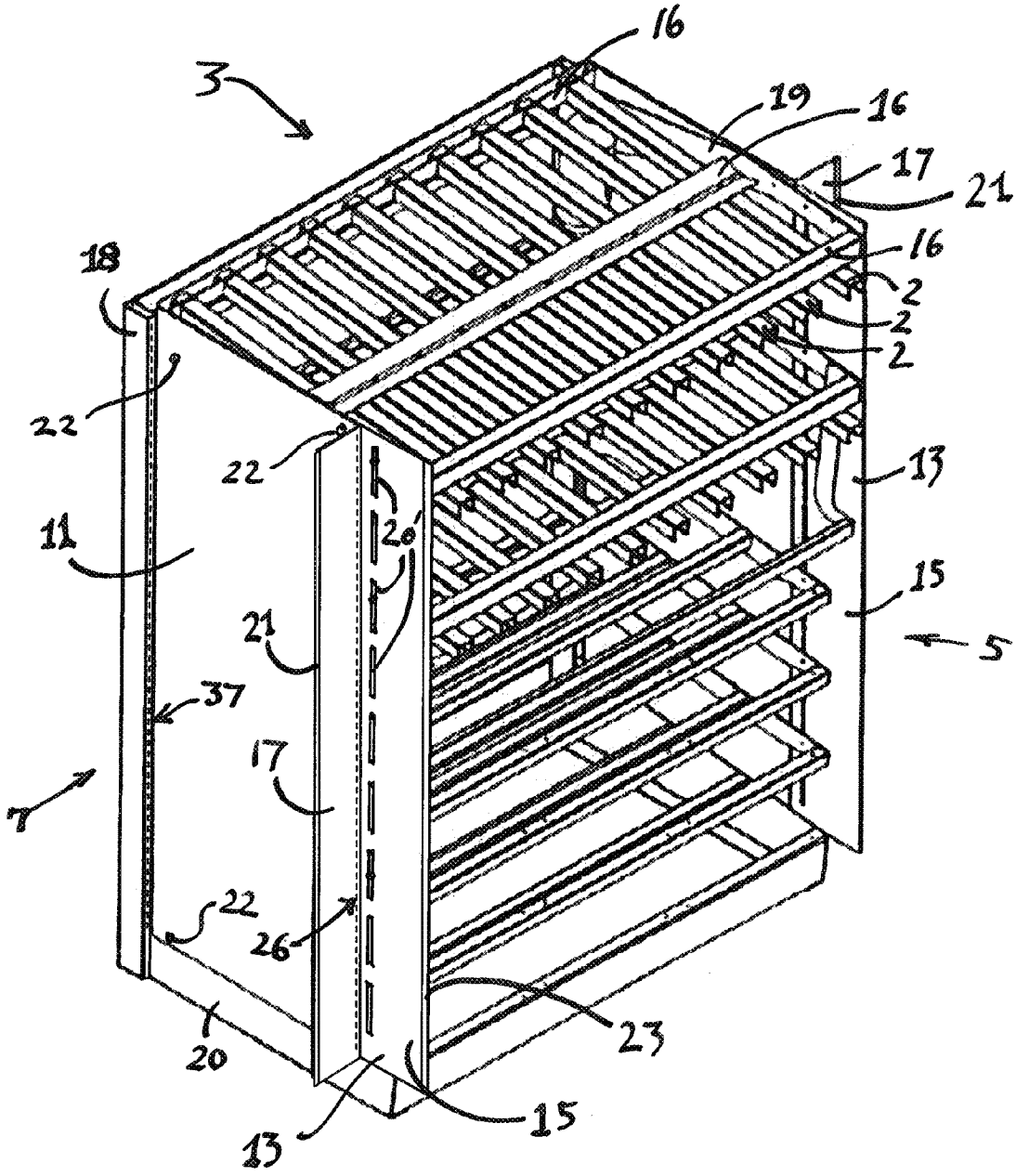
FIG. 4 is a perspective view of a display rack as seen in FIG. 1, but without the products, the side wall product baskets, or the advertising panels.

The rack 3 comprises two rear pillars 18 supported vertically on a rolling base 20. The pillars 18 each have two laterally-spaced vertical rows of slots therein. Arms 19 are releasably secured in selected slots of the laterally inward rows of slots in the pillars 18 at an appropriate height, and project forwardly therefrom. Cross beams 16 extend between the arms 19 and fixedly support the channels 2. Similar arms are inserted into lower slots in the pillars 18 and the racks that dispense the cartons 6, as seen in FIG. 4. FIG. 4 shows the product display rack 3 empty of products. The horizontal arms 19 support the channels 2. Below these, shelves that support the cartons are supported on the rack, reaching from the rear to front face 5, providing space for products to be displayed at forward face 5 from the left side of the rack to the right.

Figure 5:
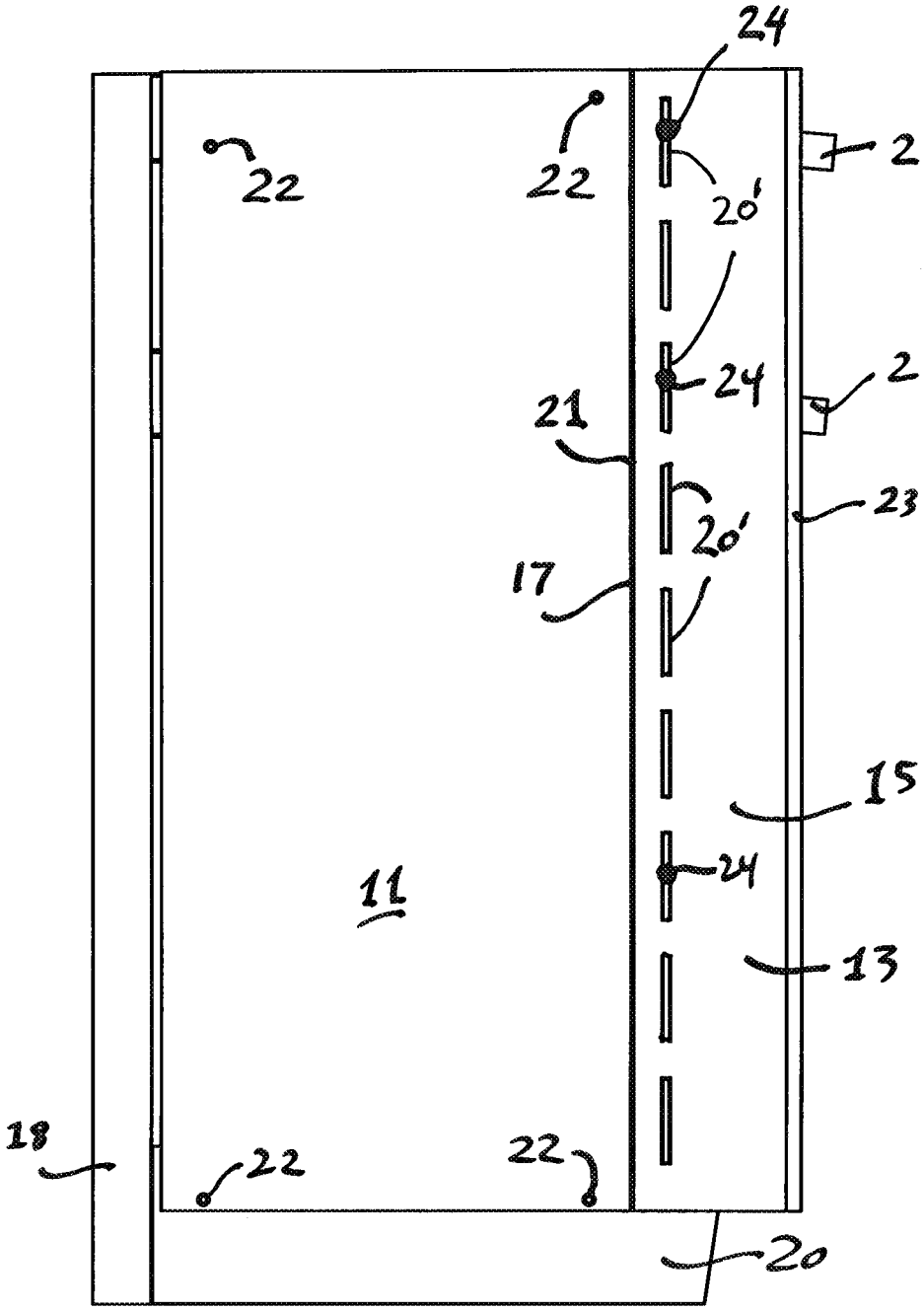
FIG. 5 is a side view of the display rack as shown in FIG. 4.

As best seen in FIG. 5, the side structures of rack 3 include a side wall member 11 that is a panel of flat, smooth plastic material secured by bolts 22 or other securing structures to arms 19 and to sides of the base 20, preferably symmetrically on the left and right lateral sides of the rack 3, so that the two lateral sides have wall members 11 that are mirror images of each other. Wall portion 11 is preferably of a plastic material such as high-impact polystyrene (HIPS) and is thin enough when mounted laterally outward of the arms 19 to provide access to the laterally outward vertical row of slots in the pillars 18.

Forward of wall portion 11, corner member 13 is secured by bolts 24 or other securing structures extending through apertures or holes 20' in the wall portion 11 and into threaded holes in arms 19 and in one or more of the shelves in the lower part of the rack 3.

The corner member 13 is a generally L-shaped member of constant cross section over its vertical length, and is of metal or a rigid plastic material such as HIPS, preferably produced by an extrusion process, as well known in the art. Corner member 13 has a first wall portion 15 parallel and aligned with side wall portion 11, and a second wall portion 17 formed integral with first wall portion 15 and extending perpendicularly laterally outward from the first wall portion 15. The left and right side corner members 13 are identical, except that they are mirror images of each other.

The vertical position of the member 13 may be selected by placing the corner member 13 in a vertical location and attaching the bolts to the shelves or arms 19 through the slots 20' in wall portion 15. The position is vertically adjustable by loosening the bolts and sliding the member 13 up or down and retightening as desired. Alternatively, the slots 20' may be replaced by keyhole openings in the wall portion 15, which, as is well known in the art, have a narrow upper slot portion that fits around the shaft of the bolt 24 and communicates with a larger lower circular bottom opening that is large enough to permit passage of the head of the bolt 24 through it.

Figure 6:
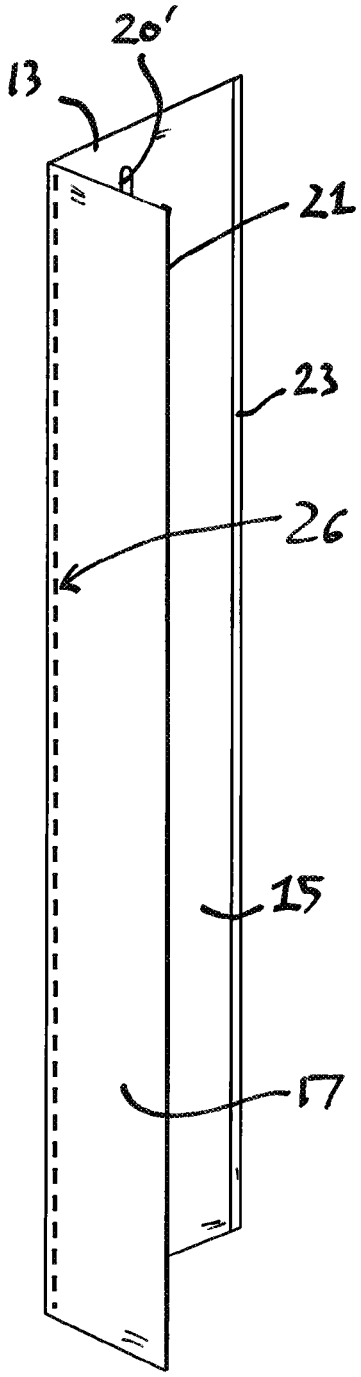
FIG. 6 shows a perspective view of a corner support member according to the invention.
Figure 7:
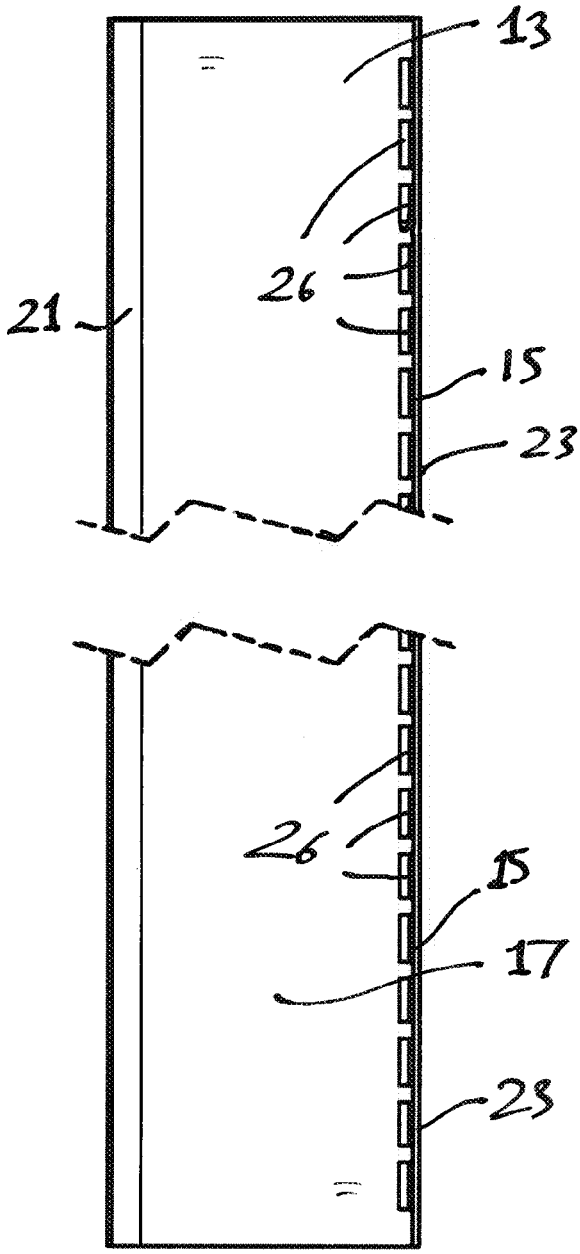
FIG. 7 shows a detailed elevational view of the member of FIG. 6.

Referring to FIGS. 6 and 7, second wall portion 17 also has therein a vertical row of slots 26 adjacent the point where it meets first wall 15. These slots 26 are similar to the vertical row of slots in the pillar 18, and the two rows face each other, allowing them to cooperate in supporting the wire baskets 10 between them in front of side wall portion 11.

Wall portion 15 has a forward vertical edge, and wall portion 17 has a lateral vertical edge. The edges each include respective retaining structures 21 and 23 that together allow the corner member 13 to receive and to retain therein a flexible signage member 27 flexed and inserted between them.

Figure 11:
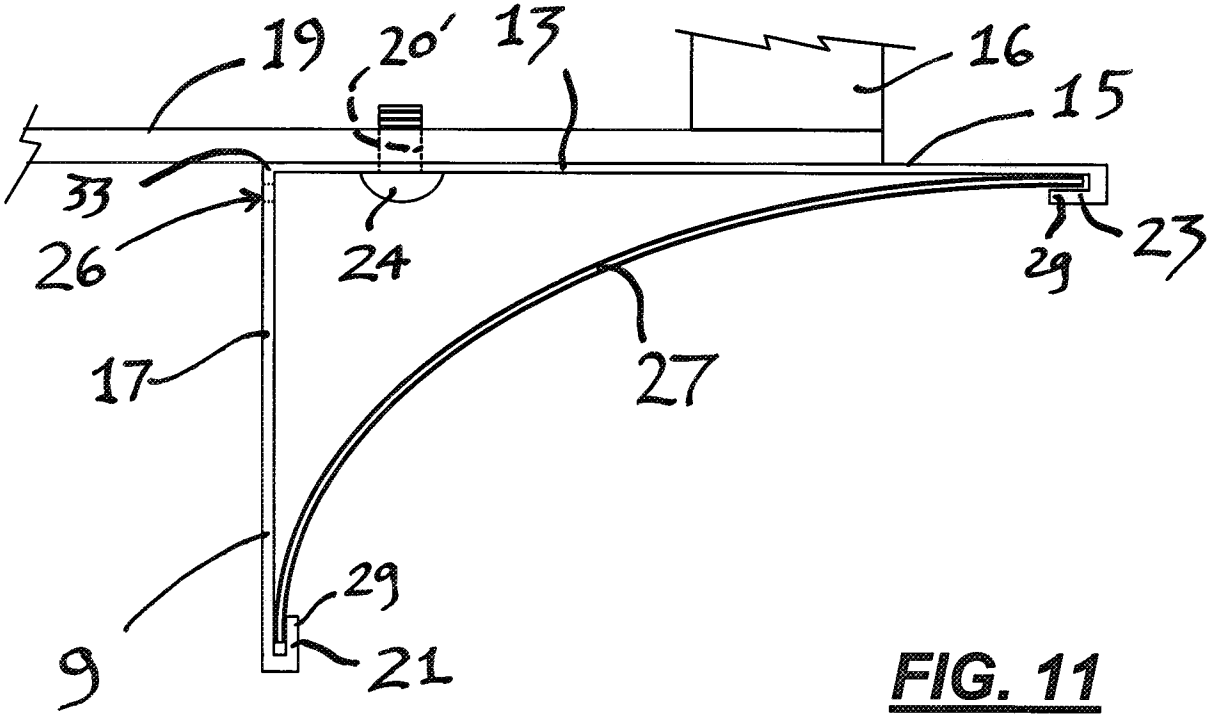
FIG. 11 is a top view of a corner member according to the invention with a flexible signage member retained therein.
Figure 12:
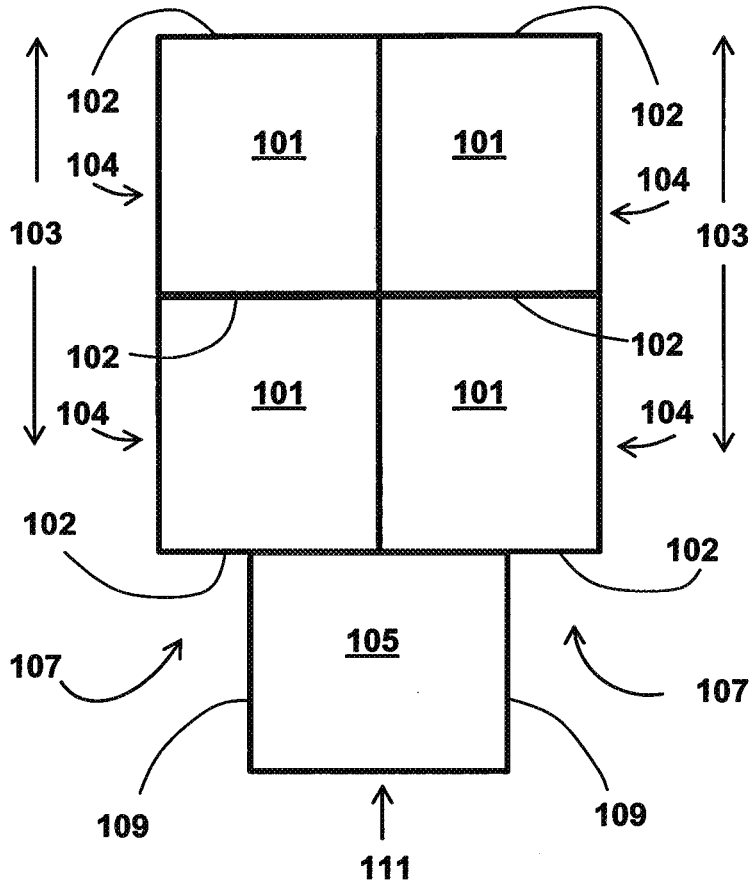
FIG. 12 is a plan view diagram of a store aisle end unit and aisle unit display racks.

FIG. 11 is a detailed top view of the corner structure 9, including the L-shaped corner member 13 and the concave front display 27. The concave front display signage member 27 is held in place by the retaining portions 21 and 23 at the edges of walls 15 and 17. The retaining portions are part of the corner member 13, and each include a portion extending back toward the inside of the L-shaped member 13 spaced from the associated wall portion 15 or 17 so as to define a recess therebetween.

The signage member 27 is a rectangular panel of flexible material that, when bent, is biased to return to a planar or near-planar condition. The panel 27 in the preferred embodiment is of HIPS material approximately 1/10 to approximately 1/8 inches thick. It is of a vertical length approximately equal to the height of the corner member 13. Its width is slightly greater than the distance between the retaining portions 21 and 23. It is installed by simply pushing the panel 27 into the L-shaped recess in member 13, causing it to flex until the distance between the lateral edges 31 of the panel is less than the distance between retaining portions 21 and 23, at which point the panel 27 snaps into the space between them. The elastic bias to return to planar then causes the panel to expand against the retaining portion 21 and 23, securing it in the corner member 13 with the edges 31 of the panel in the recesses in the retaining portions 21 and 23.

In the embodiment shown, the walls 15 and 17 are 8 and 5 inches in length, respectively, from the vertex 33 of the corner member 13. The distance between the ends of the walls 15 and 17 is approximately 9.4 inches, and the distance between the inside ends of the retaining portion walls 29 is slightly less than 9 inches. The lateral width of the panel is slightly more than 9 inches up to about 10 or 10.5 inches maximum to allow for the elastic clipping in and support of the panel 27.

It will be understood that the panel 27 is preferably provided with some sort of printed imagery applied by any technique well known in the art. Preferably the imagery relates to the products displayed on the rack 3. An additional signage structure 35 is also provided, supported above the display rack front face 5, providing a total appearance of the end unit of advertising surrounding the front face 5, i.e., the left and right corner structures 9 and their respective signage panels 27 and the signage structure 35 supported above the dispensing face 5.

There are several advantages of the disclosed display device with its side display and corner structure. For example, the concave shape permits improved viewing of the imagery on the signage from more angles. In addition, the corner structure provides a degree of protection against impacts, such as from a shopping cart bumping into the display rack at the corner, which might otherwise dislodge some products.

in addition, the corner members without the signage panel can be reversed during shipping of the rack itself so that the first wall portion 13 extends from the front face 5 rearward, and the second wall portion 15 extends laterally inward in front of the arms 19 and other structure present before final assembly in the store. The corner member 13 in this position may be bolted or secured to the arms and shelves so as to provide a vertical corner beam that reinforces and protects the unit during handling in shipment. The corner member 13 is then detached and reversed for installation.

Referring to FIGS. 1, 2 and 3, the side portions 7 include shelving in the form of welded wire baskets 10 extending between the rear wall portion 17 of corner member 13 and the rear pillar 18 laterally outward of side wall member 11. As with the other elements of the side displays, all the baskets 10 and the associated structures are preferably duplicated on both lateral sides of the rack 3 as mirror images of each other. The baskets 10 are supported by insertion of their forward and rearward ends into selected slots in the row of slots 26 in wall portion 17 and the row of slots 36 in the rear pillar 18.

Figure 8:
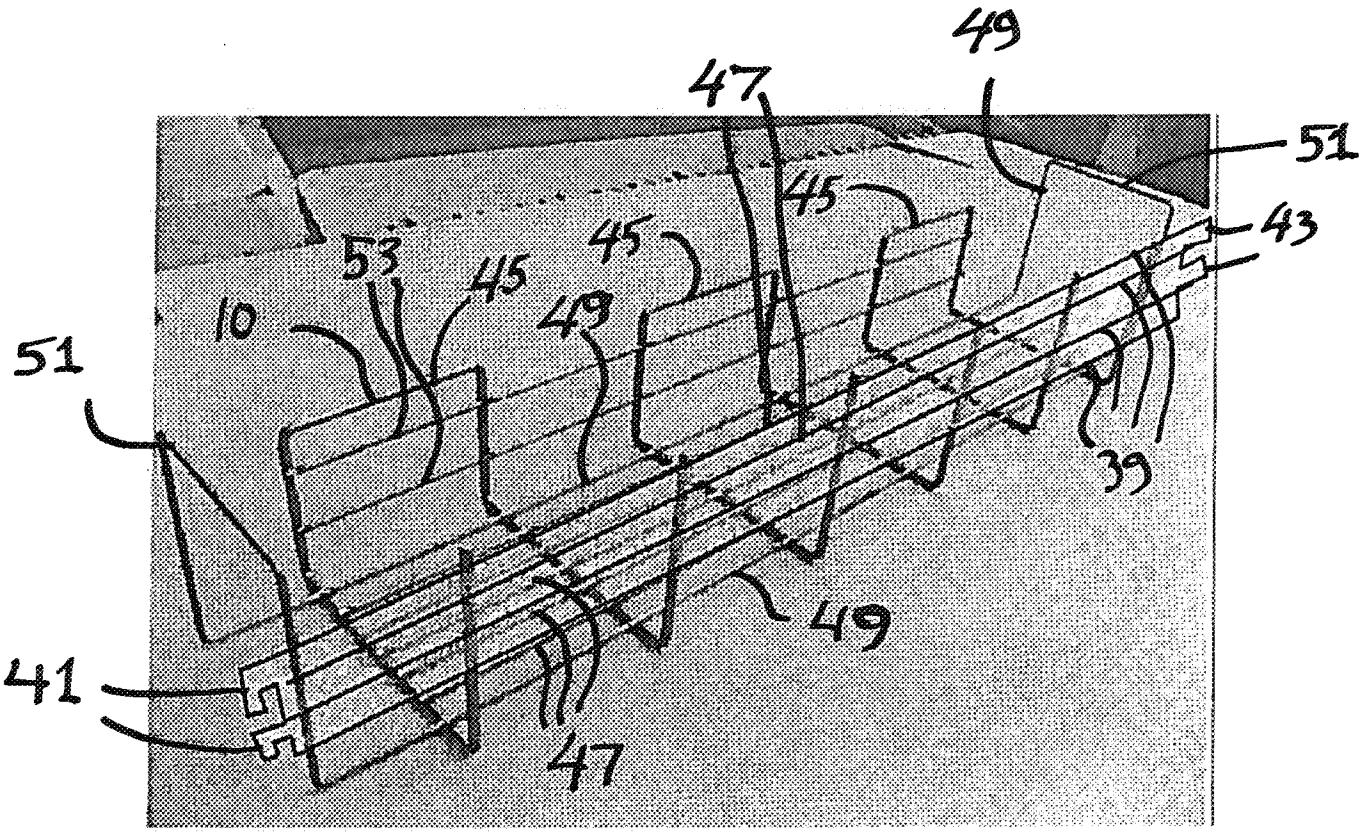
FIG. 8 shows a perspective view of an example of an interchangeable basket bracket for holding products on a side of the display rack.
Figure 9:
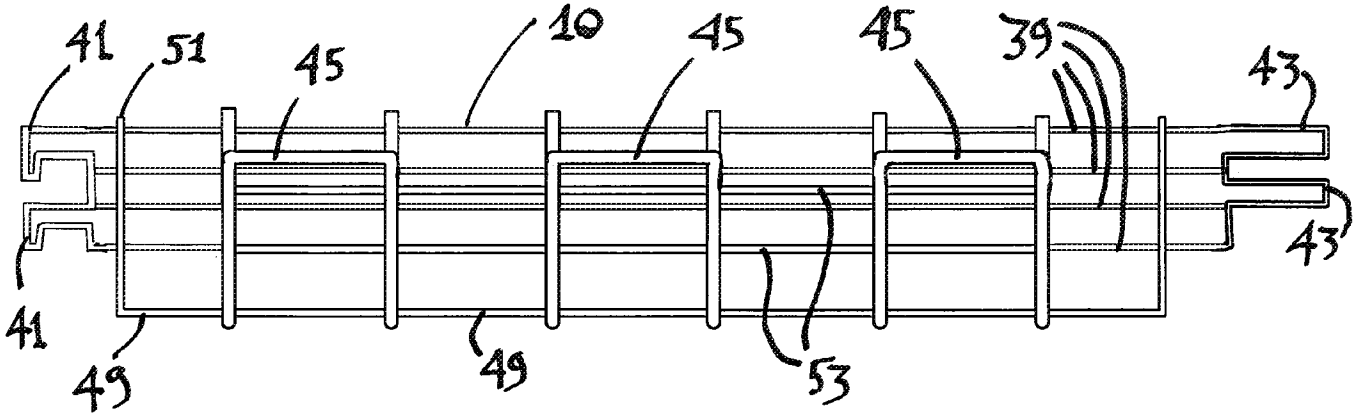
FIG. 9 is an elevational view of a basket bracket as shown in FIG. 8.
Figure 10:
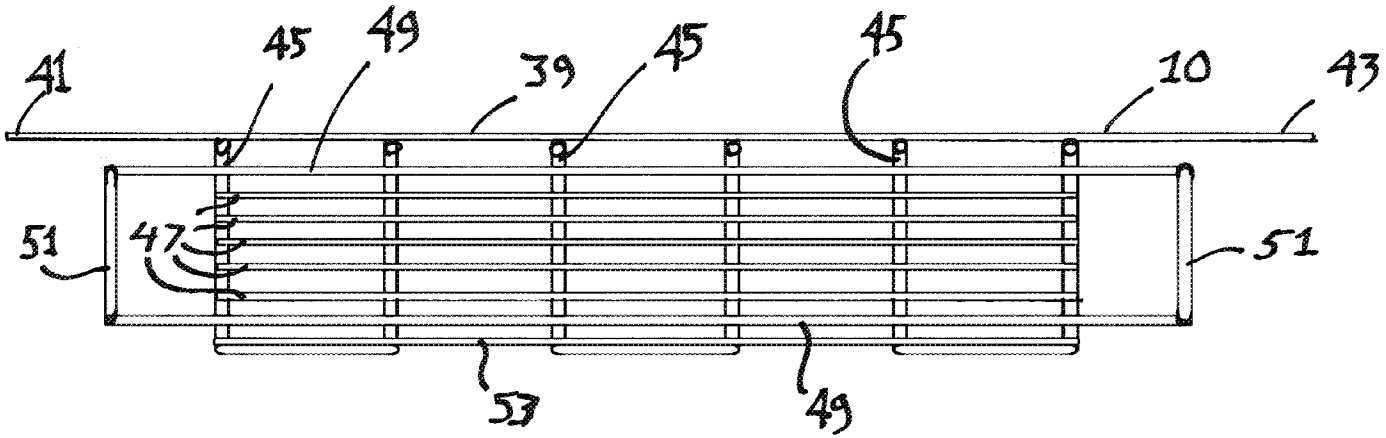
FIG. 10 is a top view of a basket bracket as shown in FIG. 8.

FIGS. 8, 9 and 10 show baskets 10 with the basket of FIG. 8 configured for use on the right lateral side of the rack 3, and the baskets of FIGS. 9 and 10 being for use on the left lateral side of the rack 3.

The baskets 10 each comprise a rear structure comprising four coplanar longitudinally extending wire members 39 that define at one end thereof a pair of hook structures 41 and a pair of tab structures 43 at the opposing end. Three wire brackets 45 are welded to the front of the four wires of the rear structure 39, and provide six longitudinally spaced U-shaped members defining a planar horizontal bottom to the shelf on which seven planarly organized wire members 47 and 49 are welded. The two outermost wire members 49 extend past the U-shaped structures and form inverted U-portions 51 that serve as longitudinal ends of the basket shelf 10. Wire cross members 53 are welded behind the laterally outer portions of the U-shaped structures to provide a front wall of the basket shelf 10.

Referring to the frontal view of the right side basket 10 in FIG. 9, the baskets may be inserted into any selected slots 26 and 37 at the same height. Placement of the basket 10 in the side display structure is accomplished by of the tabs 43 into corresponding slots 26 in wall portion 17 and pushing it forward until the rear hooks 41 can be aligned with the slots 36 in the rear pillar that are level with the slots 26.

Hook structures 41 are vertically of a dimension such that they can fit into the slots 37, and the shelf 10 is moved rearward until the hook structures 41 enter the slots 37, then the rear end of the basket 10 is lowered slightly, with the hook structures 41 secured against forward movement therein. The length of the rear structure wire members 39 is such that the tabs 43 remain in slots 26 so as to support the forward end of the basket 10 when the hook structures 43 are in the rear pillar slots 37, and the baskets 10 are supported solely by the wall portion 17 and the pillar 18 laterally outward of the wall member 11.

Removal of the basket 10 from the rack 3 is accomplished by lifting the hooks 43 up so that the shelf 10 can be moved forward and the hooks 43 withdrawn from the slots 37. The basket 10 is then angled slightly and the tabs 41 are withdrawn rearward from the slots 26, and the basket 10 is free of the rack 3.

For the purposes of promoting and understanding the principles disclosed herein, references have been made to embodiments illustrated in the drawings and specific language has been used to describe the same. It should be understood that no limitation of the scope of the invention is thereby intended. Alterations and further modifications in the illustrated device and such further applications of the principles disclosed or illustrated herein are contemplated as would normally occur to one skilled in the art to which this disclosure relates. While particular preferred embodiments have been shown and described, it will be readily apparent to those skilled in the art that changes and modifications may be made without departing from the spirit of the invention.

What is claimed is:

1. A rack system for displaying products, said rack system comprising a rack unit supporting some of the products so as to be accessed at a forward facing product dispensing face, said rack unit having a side portion facing generally perpendicular to the dispensing face;

a corner member supported on the side portion and comprising a first wall portion extending generally forwardly to a first vertical edge located adjacent the product dispensing face, and a second wall portion connected with the first wall portion rearward of the first vertical edge and extending generally laterally outward from the side portion to a second vertical edge;

said first and second edges each having a retaining portion extending vertically therealong; and a flexible signage member supported on the corner member in a flexed condition between the retaining portions with a signage surface that is outwardly concave between the retaining portions, and wherein the signage member is supported and retained on the corner member by a biasing of the signage member to extend wider than a distance between the retaining portions.

2. The rack system of claim 1, wherein the corner member is an L-shaped member wherein the first and second wall portions each constitute a respective leg of the L-shaped member.

3. The rack system of claim 2, wherein the first wall portion is mounted fixedly on the side portion of the rack unit.

4. The rack system of claim 3, wherein the first wall portion can be released and adjustingly moved up or down on the side portion.

5. The rack system of claim 2, wherein the retaining portions are each a respective slot structure wherein a portion of the associated wall portion is reversed on itself so as to form a slot receiving a respective portion of the signage member.

6. The rack system of claim 1, wherein the signage member is of generally planar material that elastically biases to return to planar when flexed.

7. The rack system of claim 1, wherein the side portion of the rack unit includes a rear pillar at a rearward end thereof.

8. The rack system of claim 7, wherein a side wall cover panel is attached to the side portion and extends from the second wall portion to the rear pillar.

9. The rack system of claim 7, wherein the side portion includes arms extending forwardly from the rear pillar as part of a structure displaying said some of the products at the forward facing product dispensing face, said corner unit being secured to the arms.

10. The rack system of claim 7, wherein a product support structure is supported on the side portion between the second wall and the rear pillar, said product support structure supporting additional products laterally outward of the side portion disposed substantially perpendicularly to the forwarding facing dispensing face.

11. The rack system of claim 10, wherein the corner structure and the rear pillar have a plurality of vertically arranged recesses therein, and the product support structure comprises a plurality of shelf units each having two opposing ends, one of said ends being received and supported in one or more recesses in the corner unit, and the other of said ends being received and supported in one or more recesses in the rear pillar.

12. The rack system of claim 11, wherein the shelf units are each a wire basket structure configured to receive and support products therein.

13. The rack system of claim 12, wherein said products are bottles.

14. The rack system of claim 10, wherein the rack unit is an end unit having a second rack unit rearward thereof, said second rack unit having a product dispensing face disposed perpendicularly to the forward facing dispensing face and a side portion facing forward relative to the end unit; and said product support structure and said corner member extending no further laterally than said product dispensing face of said second rack unit.

15. The rack system of claim 14, wherein a third rack unit with a dispensing face directed opposite to the second unit is located behind the second unit, and the third unit has a side portion facing forward toward a rear of the end unit adjacent a second opposite side portion thereof;

said end unit having thereon a second corner member with a second outwardly concave signage member in a space defined between the side portion of the third rack unit and the second side portion of the end unit.

* * * * *